US005728996A

United States Patent [19]

Park

[11] Patent Number: 5,728,996

[45] Date of Patent: Mar. 17, 1998

[54] OPERATIONAL SWITCH FOR A MICROWAVE OVEN

[75] Inventor: Yu-Soo Park, Seoul, Rep. of Korea

[73] Assignee: Daewoo Electronics Co., Ltd., Seoul, Rep. of Korea

[21] Appl. No.: 594,970

[22] Filed: Jan. 31, 1996

[30] Foreign Application Priority Data

Jun. 23, 1995 [KR] Rep. of Korea ..... 95-17207

[51] Int. Cl.[6] ..... H05B 6/68

[52] U.S. Cl. ..... 219/702; 219/715; 219/719; 219/685; 200/38 FA

[58] Field of Search ..... 219/702, 703, 219/715, 685, 719, 721, 722; 200/38 FA, 38 R

[56] References Cited

U.S. PATENT DOCUMENTS

| | | | |
|---|---|---|---|
| 5,134,262 | 7/1992 | Lee | 219/703 |
| 5,455,403 | 10/1995 | Kim et al. | 219/702 |
| 5,548,104 | 8/1996 | Ko | 219/715 |
| 5,558,796 | 9/1996 | Cho | 219/702 |

FOREIGN PATENT DOCUMENTS

| | | |
|---|---|---|
| 0 489 383 A2 | 2/1991 | European Pat. Off. . |
| 0 679 045 A2 | 4/1995 | European Pat. Off. . |
| 0 679 045 A3 | 4/1995 | European Pat. Off. . |
| 1910982 | 3/1969 | Germany . |

*Primary Examiner*—Philip H. Leung
*Attorney, Agent, or Firm*—Lowe, Price, LeBlanc & Becker

[57] ABSTRACT

Disclosed is an operational switch for a microwave oven using a pair of gears and a pair of micro switches in order for a magnetron and a heater of a microwave oven to operate. At the rear surface of a control panel, a first switch for turning on/off the magnetron and a first gear having a pair of pushing pieces for controlling the first switch are installed. At an edge of the first gear a second switch for controlling the heater is provided. A second gear for controlling the second switch is provided while meshing together with a power controlling gear of a timer body. A pair of pushing pieces are protrudingly formed on the surface of second gear. The first gear further includes a stopper and a pair of impeding pieces for limiting the rotation range and a pair of elastic pieces and a ring type guiding member for guiding the rotation. According to the invention, the productivity of a microwave oven can be improved because the number of components of a microwave oven is reduced, the bad quality components are avoided from being produced, and the assembling time of a microwave oven is shortened.

10 Claims, 10 Drawing Sheets

OPERATIONAL SWITCH FOR A MICROWAVE OVEN

BACKGROUND OF THE INVENTION

1. Field of the Invention

The present invention relates to an operational switch for a microwave oven composed of an electric heating device and a magnetron device for generating a high frequency, and more particularly to an operational switch for a microwave oven capable of controlling both a heater and a magnetron at the same time.

2. Description of the Prior Art

An electric field room of a microwave oven includes a magnetron for generating high frequency and an electric heater. The high frequency that is generated by high voltage which is generated by a mutual induction of a first and a second induction coil disposed on a lower surface of the electric field room is safely applied to the magnetron. Such a high frequency is irradiated into a cooking chamber of a microwave oven through an irradiating tube. When the high frequency is irradiated to the inside of the cooking chamber through the irradiating tube, food placed in the cooking chamber is heated and cooked.

In the microwave oven described above, a constant operating time and the strength of the power should be adjusted depending upon what kind of food is to be cooked. Accordingly, the microwave oven includes a timer for controlling a time period for which the high frequency is being generated and a power controlling device for controlling the on/off operation period of the magnetron. That is, adjusting the period of on/off operation of the magnetron means controlling the power of a microwave oven. Such a timer and a power controlling device are installed at the rear portion of a control panel. The control panel for controlling the overall operation of a microwave oven is provided at one side of a front panel of a microwave oven.

Inside the cooking chamber of a microwave oven, an electric heater is provided for heating food thereby, for example, fish, bread or cookie to be broiled or baked. The electric heater is operated by a cam installed within the power controlling device.

Around a knob of the power controlling device, five steps of BROWNER, DEFROST, COMBI, MEDIUM-HIGH and HIGH for controlling the power are provided. When the BROWNER step is selected, only the electric heater operates so that such food as fish, bread, or cookie can be broiled or baked. The DEFROST step makes the magnetron operate weakly for frozen meat to be defrosted. When the COMBI step is selected, the electric heater operates and the magnetron operates with a medium power so that a roast chicken or a roast turkey may be made. The MEDIUM-HIGH step causes the electric heater to be turned off and the magnetron operates with a medium power. Finally, the HIGH step is used for operating the magnetron with a maximum power while the electric heater is turned off.

According to such a conventional microwave oven, a timer and a power controlling device are installed at the rear portion of the control panel by using a separate bracket for timer. U. S. Pat. No. 5,455,403 discloses a power controlling device similar as described in the foregoing.

FIG. 1 shows a side sectional view of the operational switch provided in the conventional microwave oven described as above. As shown in FIG. 1, control panel 1 includes a rotating through hole 12 for a power controlling knob 10 and a rotating through hole 22 for a timer controlling knob 20. At the rear side of control panel 1, a timer bracket 30 is disposed. At timer bracket 30 a power controlling device and a timer are fixed.

The power controlling device includes a power controlling knob 10, a shaft 14, a supporting bracket 50, a cam 40, a rack 70 and a power controlling gear 60. Power controlling knob 10 is fitted to one end of shaft 14, and the other end of shaft 14 is fixed at a timer bracket 30 by means of supporting bracket 50. Between shaft 14 and supporting bracket 50, cam 40 inserted into shaft 14 is provided. Cam 40 operates the electric heater while rotating together with shaft 14 and limits the range of the rotation of shaft 14. In case of the microwave oven without a heating device, cam 40 only functions to limit the range of the rotation. At the circumference of cam 40, tooth are formed which are then matched with rack 70. At a part of rack 70, a power controlling gear 60 of a timer 80 is combined.

Timer 80 includes a timer controlling knob 20, a timer shaft 24, and power controlling gear 60. Timer controlling knob 20 is inserted into one end of timer shaft 24 and the other end of timer shaft 24 is fixed inside timer 80.

When the microwave oven constructed as such is operated, the user must manually operate power controlling knob 10 and timer controlling knob 20. When power controlling knob 10 is rotated to locate a step the user desires, the torque of output controlling knob 10 is transmitted to shaft 14. When shaft 14 rotates with a predetermined angle, cam 40 rotating according to shaft 14 operates the electric heater. As cam 40 makes a rotation movement, rack 70 meshed with cam 40 makes a rectilinear motion. The rectilinear motion of rack 70 is transmitted to power controlling gear 60 meshed with rack 70. Accordingly power controlling gear 60 makes a rotating motion. According to the rotation of power controlling gear 60, on time and off time of the magnetron within one operating period of the magnetron may relatively be prolonged or shortened.

If timer controlling knob 20 is rotated to a desired extent by a user, the torque of timer controlling knob 20 is transmitted to timer shaft 24. The rotated angle of timer shaft 24 is transmitted into timer 80 and thereby the magnetron and the electric heater operates for a predetermined time period. Thereafter, timer 80 terminates the operation of the magnetron and the electric heater.

According to the conventional microwave oven described in the foregoing, the operational switch is composed of supporting bracket 50, a plate spring (not shown), cam 40, rack 70, etc. in order to operate the magnetron and the electric heater. Accordingly, the number of the components of a microwave oven is increased and the manufacturing cost becomes high. Further, due to the complicated structure of rack 70, the manufacturing and assembling thereof is difficult.

SUMMARY OF THE INVENTION

Therefore, it is an object of the present invention to provide an operational switch for a microwave oven having a simple structure and a minor number of components so that the manufacturing cost can be reduced and the working efficiency can be improved.

The above object of the present invention can be achieved by providing an operational switch for a microwave oven comprising a knob inserted rotatably into a control panel; a first gear, the knob having a shaft being inserted into the center of the first gear, and a pair of pushing pieces being projected on one side thereof; a first switch for controlling a magnetron by means of the pushing pieces of the first gear;

a second gear meshed with the first gear by teeth, a pair of pushing pieces being projected on one face of the second gear, and a small sized gear meshed with a gear of the magnetron is provided on an opposite face of the second gear; and a second switch for controlling an electric heater by means of the pushing pieces of the second gear, whereby the rotation of the knob is transmitted to the first gear, the rotational position of the pushing piece of the first gear, the rotation of the first gear turning on/off the first switch, the rotation of the first gear is transmitted to the second gear, and the rotational position of the pushing piece, of the second gear turning on/off the second switch and simultaneously rotates the power controlling gear.

At this time, it is preferable that the first gear further includes a means for limiting the range of the rotation for the first gear to rotate within a predetermined angle. The rotation range limiting means may include a stopper protrudingly formed on one side of the first gear and a pair of impeding pieces protrudingly formed on the control panel supporting the knob shaft thereby to contact with the stopper.

Also, it is preferable that the first gear further includes a means for guiding the rotation site of the first gear. The rotation guiding means may include a pair of elastic pieces protrudingly and opposingly formed on the control panel and a ring type guiding member with plural grooves receiving the elastic pieces provided on one side of the first gear.

Further, the above object of the present invention can be accomplished by providing an operational switch for a microwave oven comprising a knob inserted rotatably into a control panel; a ring-shaped first gear with a plurality of grooves to receive a pair of elastic pieces protrudingly and oppositely formed on the control panel, a shaft of the knob being inserted into the center of the first gear, a pair of pushing pieces being protruded on one side thereof, and a stopper being formed at an edge of the pushing piece to contact with a pair of impeding pieces protrudingly formed on the control panel; a first switch for controlling the magnetron by means of the pushing pieces of the first gear; a second gear meshed with the first gear by teeth, a pair of pushing pieces being projected on one face of the second gear, and a small- sized gear meshed with a power controlling gear of the magnetron for controlling the magnetron power being provided on the other side thereof; a second switch for controlling an electric heater by means of the pushing pieces of the second gear, whereby the rotation of the knob is transmitted to the first gear, the rotational position of the pushing piece of the first gear controls the first switch, the rotational of the first gear is transmitted to the second gear, and the rotational position of the pushing piece of the second gear controls the second switch and simultaneously rotates the power controlling gear.

According to the construction as above, when the shaft of the knob rotates, the first gear assembled with the knob shaft is caused to rotate. The rotation of the first gear is transmitted to the second gear to thereby rotate the power controlling gear of the timer. According to the rotation of the first gear, the pushing pieces of the first gear control the first switch. Since the first switch is connected to the electric heater, the rotation of the first gear turns the heater on or off. As the second gear rotates, the pushing pieces of the second gear turn the second switch on or off. Since the second switch is connected to the magnetron, the rotation of the second gear operates the magnetron.

BRIEF DESCRIPTION OF THE DRAWINGS

The object and advantages of the present invention will be more clearly understood to those skilled in the art with reference to the accompanying drawings in which.

DESCRIPTION OF THE PREFERRED EMBODIMENT

The present invention will now be described in detail referring to the accompanying drawings.

Figure 1:
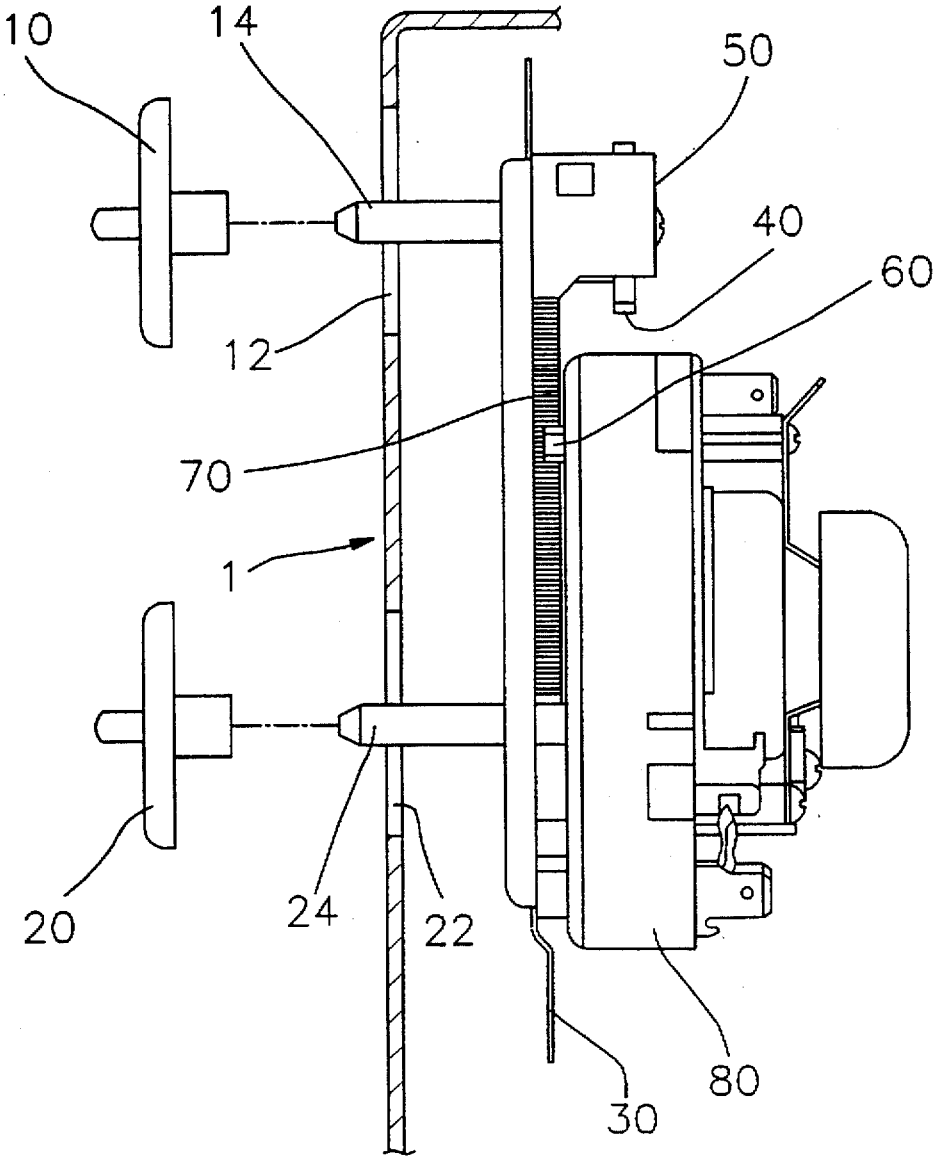
FIG. 1 (PRIOR ART)
FIG. 1 is a side sectional view of an operational switch installed in a conventional microwave oven.
Figure 2:
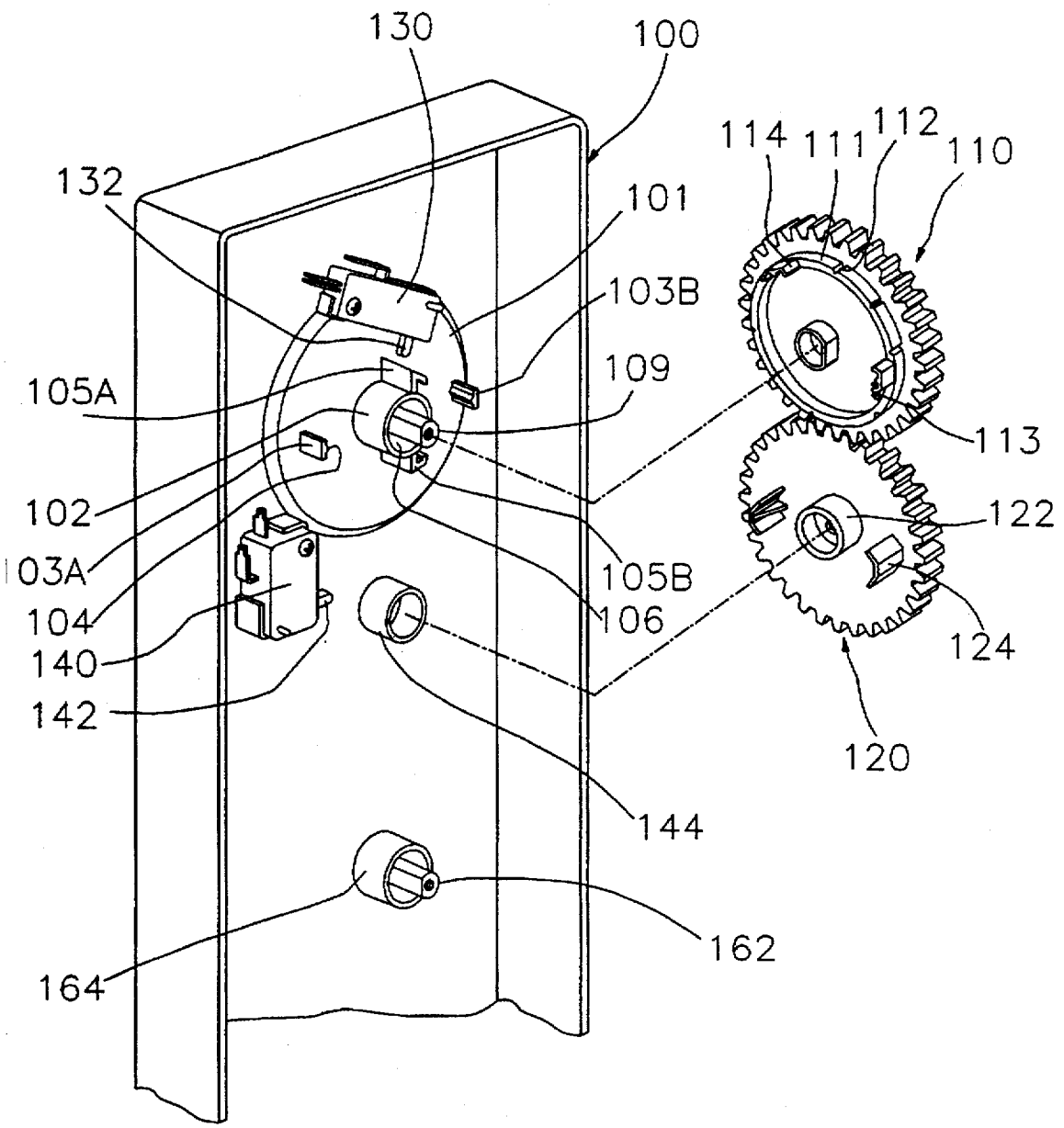
FIG. 2 is a perspective view of a separate state of an operational switch for a microwave oven according to one embodiment of the present invention.

FIG. 2 is a perspective view of the separate state of an operational switch of a microwave oven according to one embodiment of the present invention. A control panel 100 is disposed at one side portion of the front side of a microwave oven. On the front side of control panel 100, a knob or power controlling knob (not shown) and a timer knob (not shown) are installed and on the rear side thereof gears 110 and 120, switches 130 and 140 and a timer (not shown) are provided.

At an upper portion of control panel 100, a projecting portion 101 in the form of a circle is projected toward back direction of the control panel 101. At the center of projecting portion 101 a knob shaft through hole 106 is formed. A knob shaft 109 of a power controlling knob (not shown) is rotatably inserted into knob shaft through hole 106. Around the periphery of knob shaft through hole 106, a boss 102 with a predetermined length is protrudingly formed toward the back direction of control panel 100. On the circumferential surface of boss 102 a pair of impeding pieces 105A and 105B are protrudingly formed with a predetermined length in an upper and a lower direction respectively. A pair of elastic pieces 103A and 103B are protrudingly formed at opposite sites on projecting portion 101 with a predetermined distance from the center of projecting portion 101. Elastic pieces 103A and 103B can be elastically bent in a right and left directions respectively with a fixing end in the center. An engaging jaw 104 is formed on an opposite surface of the elastic piece.

At an edge of projecting portion 101, a first switch 130 for operating a heater 153 is fixed. First switch 130 has a contact protuberance 132 formed to be pushed in a radial direction of projecting portion 101.

At a portion separated from projecting portion 101 toward the site of the timer knob with a predetermined distance, a second gear boss 144 for fixing the rotating center of a second gear 120 is protrudingly formed on the rear side of control panel 100. Second gear boss 144 is formed in the shape of a cylinder and has a second switch 140 fixed at an edge thereof. Second switch 140 is situated at a site separated from second gear boss 144 in a radial direction with a predetermined distance and performs an on/off operation of a magnetron 155.

At a lower portion of control panel 100, another boss 164 is formed. Boss 164 receives a timer knob shaft 162 from the front side of control panel 100 and is rotatable.

First gear 110 is inserted into power controlling knob shaft 109. On the circumference of first gear 110, teeth are formed and the through hole of first gear 110 is formed suitable to be assembled with power controlling knob 109. On one of the surfaces of first gear 110 which is to meet with projecting portion 101, a guiding member 111, a pushing piece 114 and a stopper 113 are protrudingly formed. Guiding member 111 is made in the shape of a ring and has a plurality of grooves 112 formed along the circumference with the same gap. Groove 112 can receive engaging jaw 104 of elastic piece 103 by elasticity. A pair of pushing pieces 114 on guiding member 111 are formed integrally with guiding member 111 toward projecting portion 101. A pair of pushing pieces 114 are separated from each other with a predetermined distance on guiding member 111 and each of pushing pieces 114 has slanting parts at both ends thereof for convenient approach to and separation from contact protuberance 132 of first switch 130. Stopper 113 is protrudingly formed at a site that first gear 110 interferes with a pair of impeding pieces 105A and 105B during the rotation of first gear 110.

Second gear 120 is inserted into second gear boss 144 while meshing together with first gear 110. On the surface of second gear 120 toward control panel 100, a pair of pushing pieces 124 and a gap maintaining portion 122 are formed and on the other surface a small size gear 170 meshing together with power controlling gear 172 of the timer is integrally formed.

A pair of pushing pieces 124 are opposingly situated at the site capable of contacting a contact protuberance 142 of second switch 140 with gap maintaining portion 122 of second gear 120 in the center. Each of the pushing pieces has slanting parts at both ends thereof for a convenient approach to and separation from contact protuberance 142.

FIGS. 4, 7, 10, 13 and 16 illustrate front views of a power controlling knob 160 installed on the front side of control panel 100 respectively. Around power controlling knob 160, five power controlling steps of BROWNER, DEFROST, COMBI, MEDIUM-HIGH and HIGH are provided. Accordingly, a user can select his/her desired power position by manually rotating power controlling knob 160.

FIGS. 5, 8, 11, 14 and 17 illustrate power circuit diagrams of a microwave oven according to the present invention.

An electric heater 153 for generating heat and a magnetron 155 for producing high frequency are connected in parallel against an alternating power 151. Second switch 140 is situated between power 151 and magnetron 155. A branch terminal between second switch 140 and power 151 is used as a common terminal (COM). One end of a first switch 130 is a common terminal and the other end thereof contacts a normal close terminal (NC) or a normal open terminal (NO) in the alternative. Normal open terminal is connected to a heater 153 and normal close terminal is connected to magnetron 155. An oven thermistor 157 is connected between power 151 and first switch 130 in order to avoid the overheating of a microwave oven. In addition, a timer is connected in series between power 151 and second switch 140 but that is not shown in the drawings. The timer operates heater 153 or magnetron 155 only for the time period the user set and after the time period set by the user, heater 153 and magnetron 155 are opened due to power 151.

In the microwave oven according to the present invention described in the foregoing, the operational switch operates as below.

Figure 3:
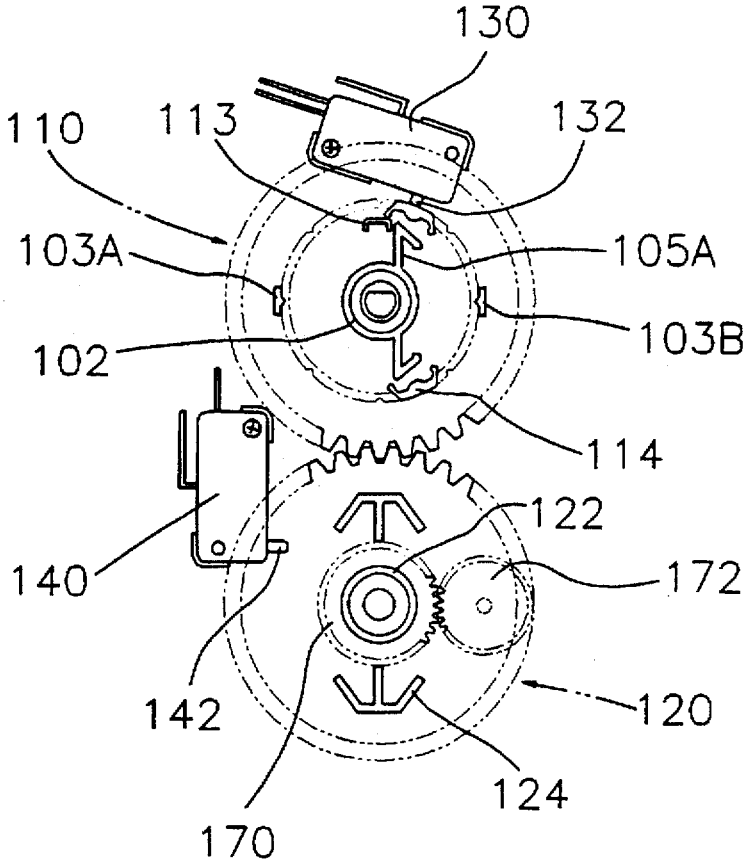
FIG. 3 is a front view of the operational switch showing the state that a power controlling knob as shown in FIG. 2 is located at a step of BROWNER.
Figure 4:
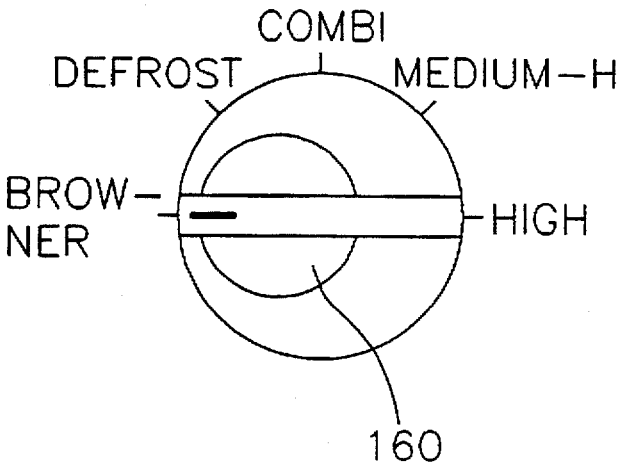
FIG. 4 is a front view of the power controlling knob as shown in FIG. 3.
Figure 5:
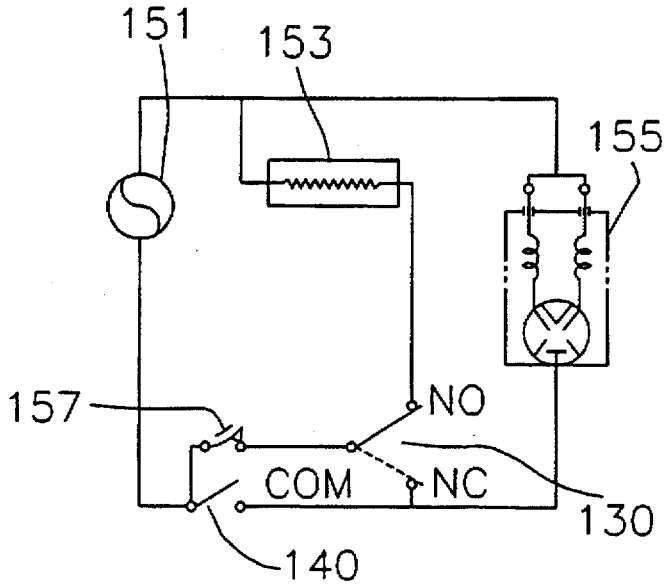
FIG. 5 is a power circuit diagram of the microwave oven according to FIG. 3.

FIG. 3 illustrates a front view of the operational switch when power controlling knob 160 as shown in FIG. 2 is situated at the step of BROWNER. FIG. 4 illustrates a front view of power controlling knob 160 according to FIG. 3. FIG. 5 illustrates a power circuit diagram of a microwave oven according to FIG. 3.

If power controlling knob 160 is located at the step of BROWNER as shown in FIG. 4, a pair of elastic pieces 103A and 103B are engaged in groove 112 of guiding member 111 as shown in FIG. 3. Stopper 113 prohibits first gear 110 from rotating in a clockwise direction by contacting an impeding piece 105A. Pushing piece 114 puts pressure upon contact protuberance 132 of first switch 130. At this time, pushing piece 124 of second gear 120 does not press against contact protuberance 142 of second switch 140.

FIG. 5 illustrates a diagram of the power circuit of a microwave oven when power controlling knob 160 is situated at the step of BROWNER. Since contact protuberance 132 of first switch 130 is pressed, the common terminal is connected to the normal open terminal. Contact protuberance 142 of second switch 140 is not pressed, therefore second switch 140 is opened. Accordingly, only heater 153 is connected to power 151 but magnetron 155 is not connected to power 151. That is to say, only heater 153 operates for the time period set by the timer. By doing such, the grill function of a microwave oven is accomplished.

Figure 6:
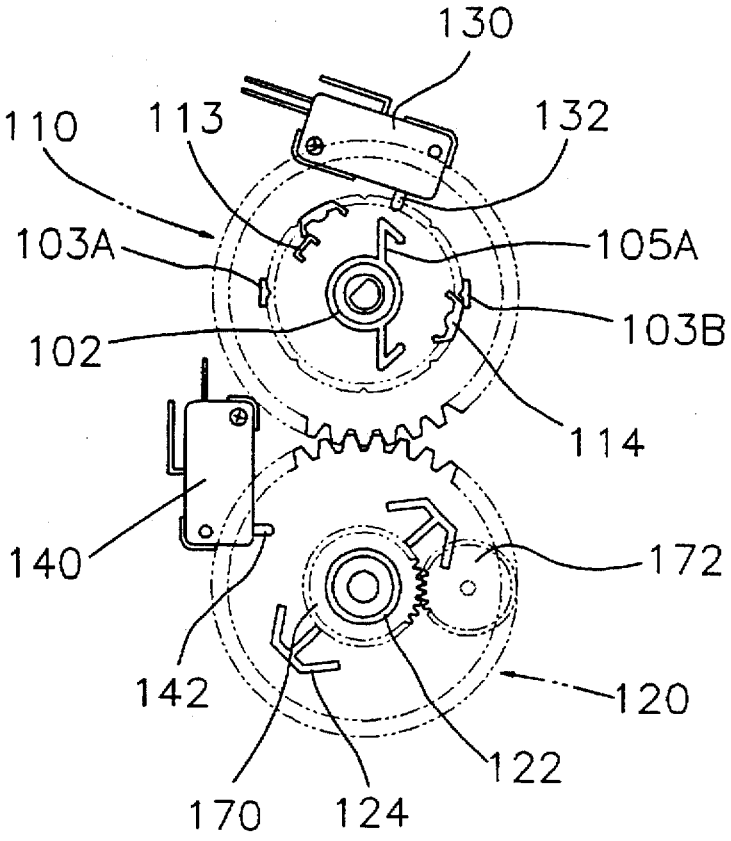
FIG. 6 is a front view of the operational switch showing the state that the power controlling knob as shown in FIG. 2 is placed at a step of DEFROST.
Figure 7:
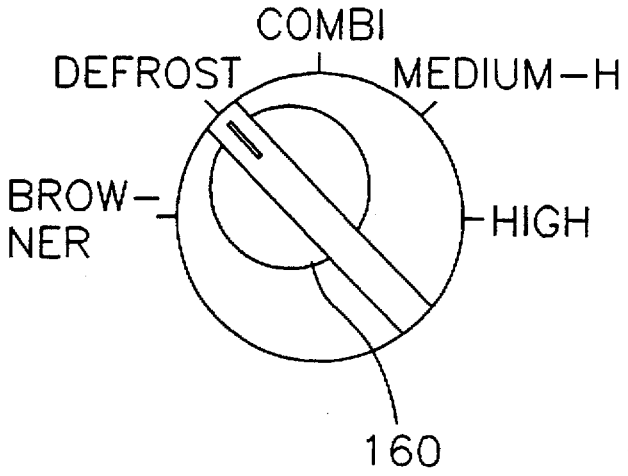
FIG. 7 is a front view of the power controlling knob as shown in FIG. 6.
Figure 8:
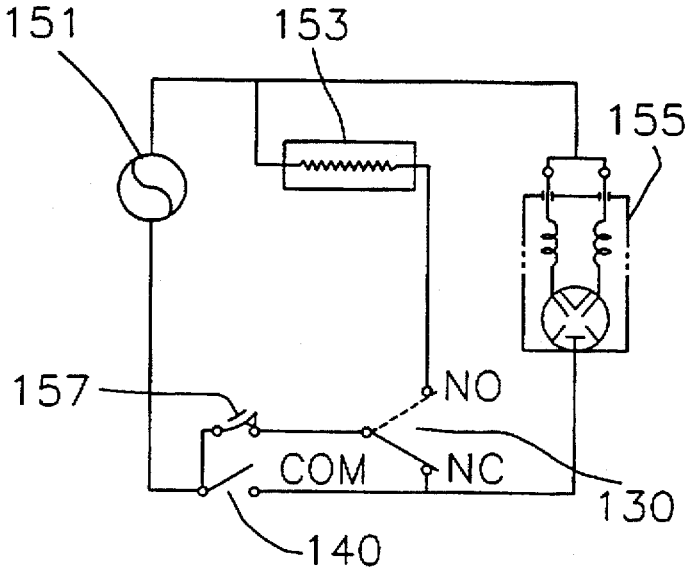
FIG. 8 is a power circuit diagram of the microwave oven according to FIG. 6.

FIG. 6 illustrates a front view of the operational switch when power controlling knob 160 as shown in FIG. 2 is situated at the step of DEFROST. FIG. 7 illustrates a front view of power controlling knob 160 according to FIG. 6. FIG. 8 illustrates a diagram of the power circuit of a microwave oven according to FIG. 6.

If power controlling knob 160 is located at the step of DEFROST as shown in FIG. 7, a pair of elastic pieces 103A and 103B are engaged in groove 112 of guiding member 111 as shown in FIG. 6. Stopper 113 enables first gear 110 to rotate in a clockwise or counterclockwise direction by departing from impeding piece 105A. Since pushing piece 114 has rotated in a counterclockwise direction on the basis of the BROWNER condition, pushing piece does not press contact protuberance 132 of first switch 130. At this time, second gear 120 rotates in a clockwise direction. The angle of which second gear 120 has rotated in a clockwise direction is transmitted to power controlling gear 172 of the timer through small-sized gear 170 integrally formed with second gear 120. Then power controlling gear 172 causes the power of magnetron 155 to become a "weak" condition. At this time, pushing piece 124 of second gear 120 does not press contact protuberance 142 of second switch 140.

FIG. 8 illustrates a diagram of the power circuit of a microwave oven when power controlling knob 160 is situated at the step of DEFROST. Since contact protuberance 132 of first switch 130 is not pressed, the common terminal is connected to the normal close terminal. Also contact protuberance 142 of second switch 140 is not pressed, therefore second switch 140 is opened. Accordingly, only magnetron 155 is connected with power 151 but heater 153 is not connected to power 151. That is to say, only magnetron 155 operates according to the power and the time period which have been set by the timer. By doing this, only the original function of a microwave oven is accomplished.

Figure 9:
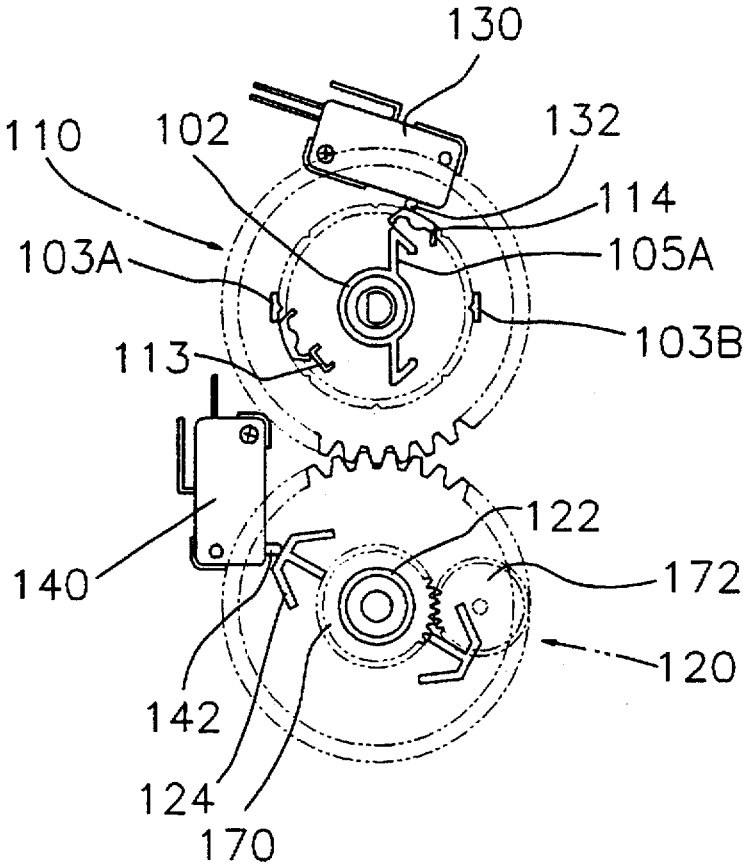
FIG. 9 is a front view of the operational switch showing the state that the power controlling knob as shown in FIG. 2 is situated at a step of COMBI.
Figure 10:
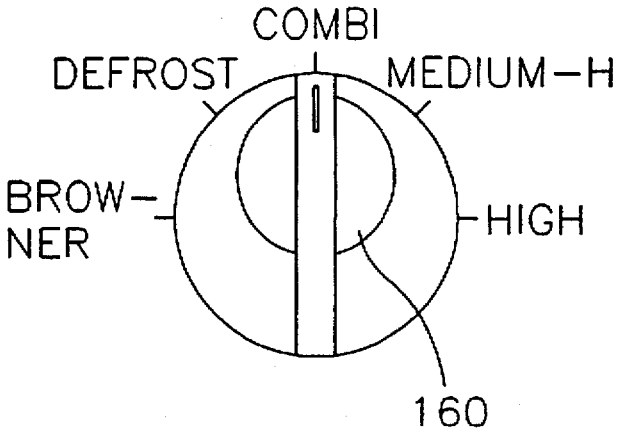
FIG. 10 is a front view of the power controlling knob as shown in FIG. 9.
Figure 11:
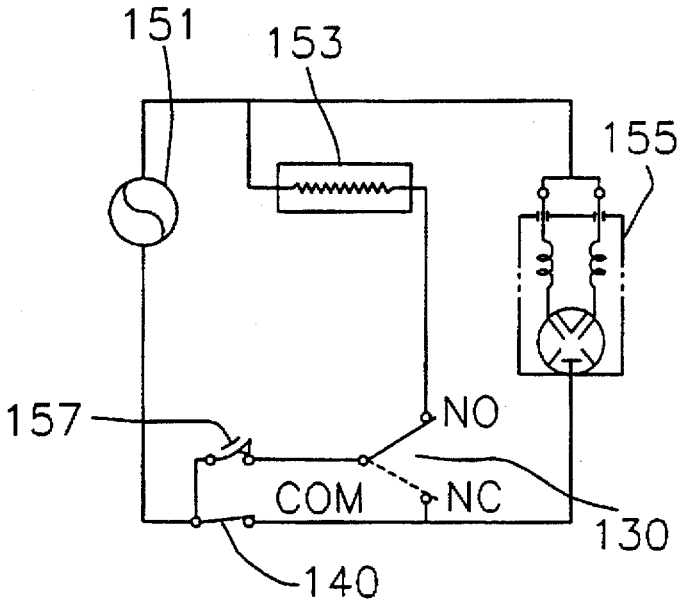
FIG. 11 is a power circuit diagram of the microwave oven according to FIG. 9.

FIG. 9 illustrates a front view of the operational switch when power controlling knob 160 as shown in FIG. 2 is situated at the step of COMBI. FIG. 10 illustrates a front view of power controlling knob 160 according to FIG. 9. FIG. 11 illustrates a diagram of the power circuit of a microwave oven according to FIG. 9.

If power controlling knob 160 is located at the step of COMBI as shown in FIG. 10, a pair of elastic pieces 103A and 103B are engaged in groove 112 of guiding member 111 as shown in FIG. 9. Stopper 113 enables first gear 110 to rotate in a clockwise or counterclockwise direction by further departing from impeding piece 105A. Since pushing piece 114 has rotated in a counterclockwise direction on the basis of the DEFROST condition, pushing piece presses contact protuberance 132 of first switch 130. At this time, second gear 120 rotates in a clockwise direction. The angle of which second gear 120 has rotated in a clockwise direction is transmitted to power controlling gear 172 of the timer through small-sized gear 170 integrally formed with second gear 120. Then power controlling gear 172 causes the power of magnetron 155 to become a "medium" condition. At this time, pushing piece 124 of second gear 120 presses contact protuberance 142 of second switch 140.

FIG. 11 illustrates a diagram of the power circuit of a microwave oven when power controlling knob 160 is situated at the step of COMBI. Since contact protuberance 132 of first switch 130 is under pressure, the common terminal is connected to the normal open terminal. Also contact protuberance 142 of second switch 140 is pressed, therefore second switch 140 is closed. Accordingly, both magnetron 155 and heater 153 are connected to power 151. That is, magnetron 155 operates according to the power and the time period which have been set by the timer, and heater 153 operates for the time period set by the timer. By doing such, the combi function of a microwave oven which means the grill function plus the original microwave oven function is achieved.

Figure 12:
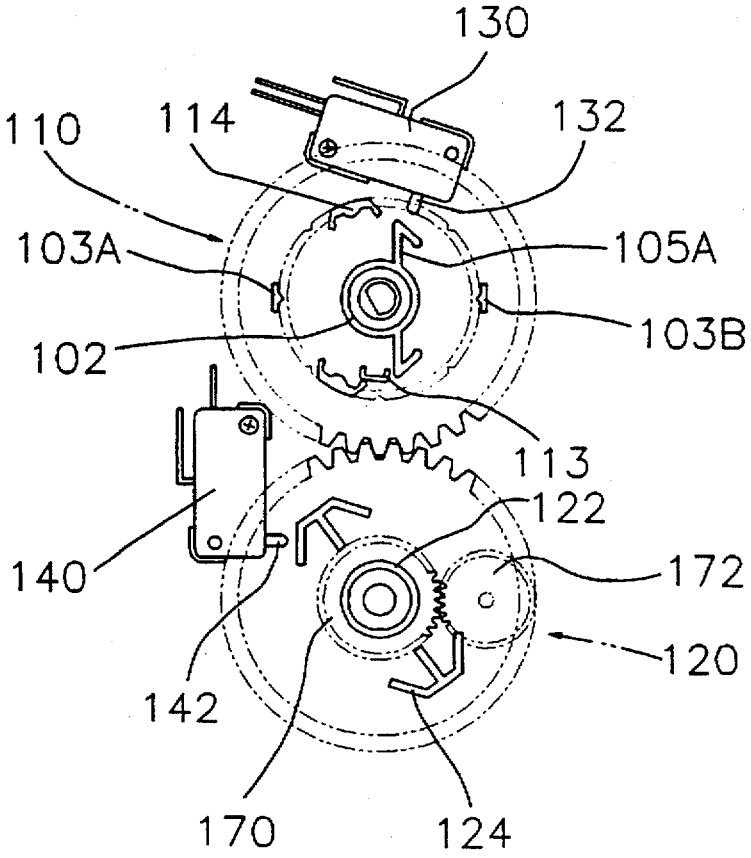
FIG. 12 is a front view of the operational switch showing the state that the power controlling knob as shown in FIG. 2 is situated at a step of MEDIUM-HIGH.
Figure 13:
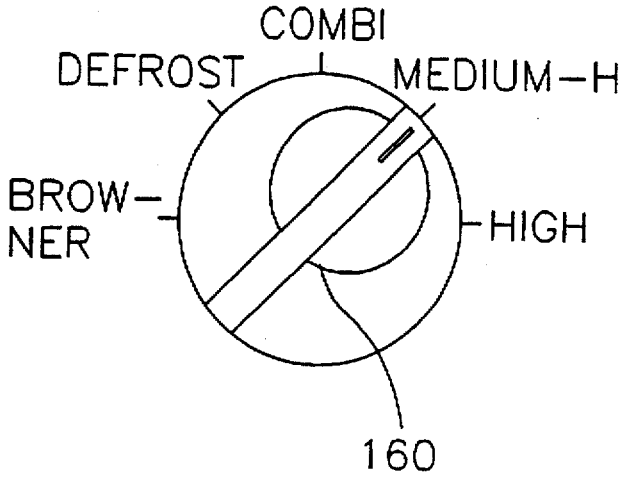
FIG. 13 is a front view of the power controlling knob as shown in FIG. 12.
Figure 14:
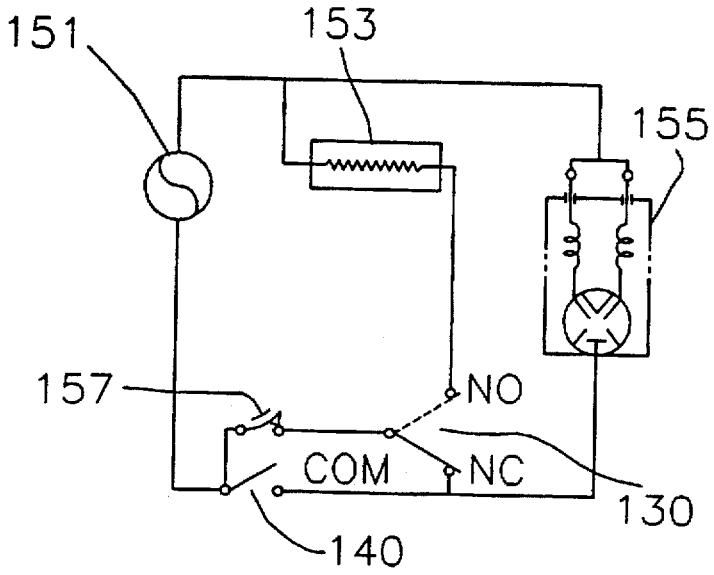
FIG. 14 is a power circuit diagram of the microwave oven according to FIG. 12.

FIG. 12 illustrates a front view of the operational switch when power controlling knob 160 as shown in FIG. 2 is situated at the step of MEDIUM-HIGH. FIG. 13 illustrates a front view of power controlling knob 160 according to FIG. 12. FIG. 14 illustrates a diagram of the power circuit of a microwave oven according to FIG. 12.

If power controlling knob 160 is located at the step of MEDIUM-HIGH as shown in FIG. 13, a pair of elastic pieces 103A and 103B are engaged in groove 112 of guiding member 111 as shown in FIG. 12. Stopper 113 enables first gear 110 to rotate in a clockwise or counterclockwise direction by further departing from impeding piece 105A. Since pushing piece 114 has rotated in a counterclockwise direction on the basis of the COMBI condition, pushing piece 114 presses contact protuberance 132 of first switch 130. At this time, second gear 120 rotates in a clockwise direction. The angle of which second gear 120 has rotated in a clockwise direction is transmitted to power controlling gear 172 of the timer through small-sized gear 170 integrally formed with second gear 120. Then power controlling gear 172 makes the power of magnetron 155 "medium" condition. At this time, pushing piece 124 of second gear 120 does not press contact protuberance 142 of second switch 140.

FIG. 14 illustrates a diagram of the power circuit of a microwave oven when power controlling knob 160 is situated at the step of MEDIUM-HIGH. Since contact protuberance 132 of first switch 130 is pressed, the common terminal is connected to the normal close terminal. Also, contact protuberance 142 of second switch 140 is not pressed, therefore second switch 140 is opened. Accordingly, magnetron 155 is connected with power 151 but heater 153 is not connected to power 151. That is, only magnetron 155 operates according to the power and the time period which have been set by the timer, but heater 153 does not operate. By doing such, only the original microwave oven function is accomplished.

Figure 15:
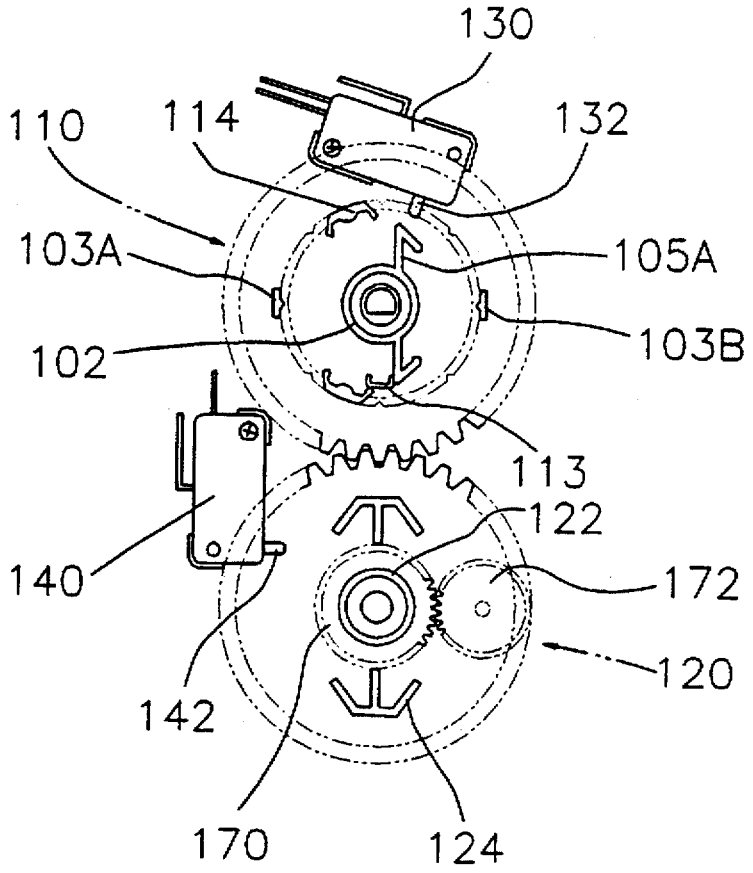
FIG. 15 is a front view of the operational switch showing the state that the power controlling knob as shown in FIG. 2 is placed at a step of HIGH.
Figure 16:
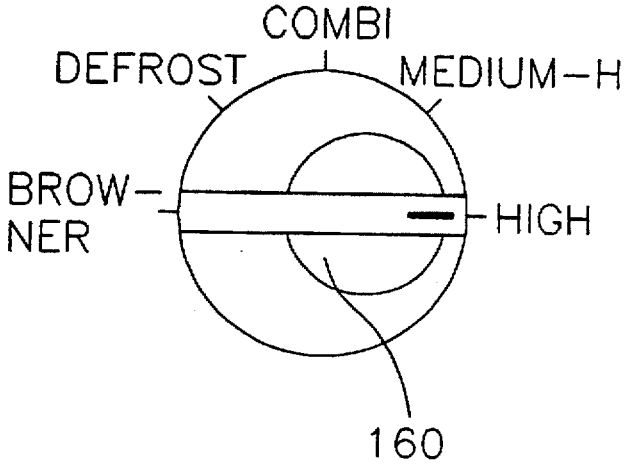
FIG. 16 is a front view of the power controlling knob as shown in FIG. 15.
Figure 17:
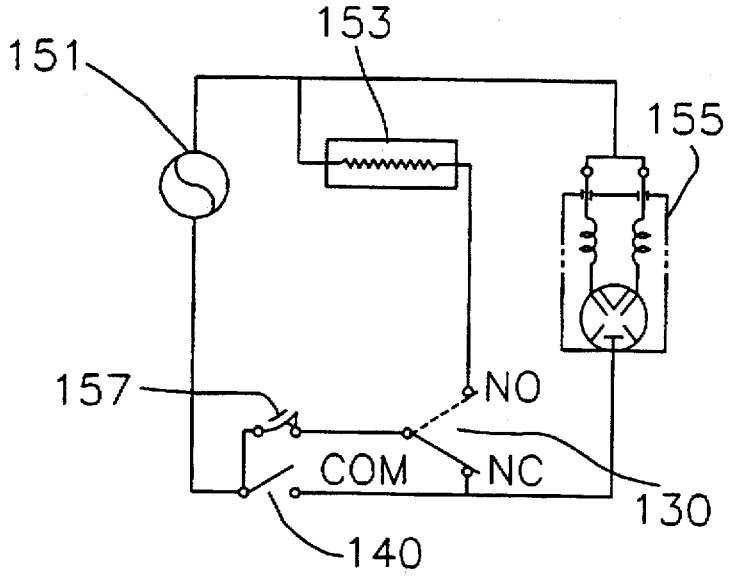
FIG. 17 is a power circuit diagram of the microwave oven according to FIG. 15.

FIG. 15 illustrates a top view of the operational switch when power controlling knob 160 as shown in FIG. 2 is situated at the step of HIGH. FIG. 16 illustrates a front view of power controlling knob 160 according to FIG. 15. FIG. 17 illustrates a diagram of the power circuit of a microwave oven according to FIG. 15.

If power controlling knob 160 is located at the step of HIGH as shown in FIG. 16, a pair of elastic pieces 103A and 103B are engaged in groove 112 of guiding member 111 as shown in FIG. 15. Stopper 113 which is in contact with impeding piece 105B prohibits first gear 110 from rotating in a counterclockwise direction. Since pushing piece 114 has rotated in a counterclockwise direction on the basis of the MEDIUM-HIGH condition, pushing piece 114 does not press contact protuberance 132 of first switch 130. At this time, second gear 120 rotates in a clockwise direction. The angle of which second gear 120 has rotated in a clockwise direction is transmitted to power controlling gear 172 of the timer through small-sized gear 170 integrally formed with second gear 120. Then power controlling gear 172 causes the power of magnetron 155 to become a "strong" condition. At this time, pushing piece 124 of second gear 120 does not press contact protuberance 142 of second switch 140.

FIG. 17 illustrates a diagram of the power circuit of a microwave oven when power controlling knob 160 is situated at the step of HIGH. Since contact protuberance 132 of first switch 130 is not pressed, the common terminal is connected to the normal close terminal. Also, contact protuberance 142 of second switch 140 is not pressed, therefore second switch 140 is opened. Accordingly, magnetron 155 is connected with power 151 but heater 153 is not connected to power 151. That is, only magnetron 155 operates according to the power and the time period which have been set by the timer, but heater 153 does not operate. By doing such, only the original function of a microwave oven is performed.

According to the operational switch of a microwave oven of the present invention, a pair of gears and a pair of micro switches are used in order for a magnetron and an electric heater to operate. Therefore, the number of components of the operational switch for a microwave oven is reduced and thereby poor quality components are avoided from being produced, the assembling time thereof is shortened and the productivity thereof is improved.

It should be obvious to people skilled in the art that various other modifications can be made to the invention as described above without departing from the spirit or the scope of the invention.

What is claimed is:

1. An operational switch for a microwave oven comprising a knob inserted rotatably into a control panel;

a first gear, the knob having a shaft being inserted into the center of the first gear, and a pair of pushing pieces being protrudingly formed on one face of the first gear;

a first switch for controlling a magnetron by means of the pushing pieces of the first gear;

a second gear meshed with the first gear by teeth, a pair of pushing pieces being protrudingly formed on one face of the second gear, and a small sized gear meshed with a gear of the magnetron for controlling the magnetron power is provided on an opposite face of the second gear; and a second switch for controlling an electric heater by means of the pushing pieces of the second gear, whereby the rotation of the knob is transmitted to the first gear, the rotational position of the pushing piece of the first gear turning on/off the first switch, the rotation of the first gear is transmitted to the second gear, and the rotational position of the pushing piece of the second gear turning on/off the second switch and simultaneously rotates the power controlling gear.

2. The operational switch as claimed in claim 1, wherein the first gear further includes a means for limiting the range of the rotation for the first gear to rotate within a predetermined angle.

3. The operational switch as claimed in claim 2, wherein the rotation range limiting means include a stopper protrudingly formed on one side of the first gear and a pair of impeding pieces protrudingly formed on the control panel supporting the knob shaft to contact with the stopper.

4. The operational switch as claimed in claim 1, wherein the first gear further includes a means for guiding the rotation site of the first gear.

5. The operational switch as claimed in claim 2, wherein the first gear further includes a means for guiding the rotation site of the first gear.

6. The operational switch as claimed in claim 3, wherein the first gear further includes a means for guiding the rotation site of the first gear.

7. The operational switch as claimed in claim 4, wherein the rotation guiding means include a pair of elastic pieces protrudingly formed on the control panel opposite to each other and a ring type guiding member provided on one side of the first gear and a plurality of grooves receiving the elastic pieces being formed at the outer periphery of the guiding member.

8. The operational switch as claimed in claim 5, wherein the rotation guiding means include a pair of elastic pieces protrudingly formed on the control panel opposite to each other and a ring type guiding member provided on one side of the first gear and a plurality of grooves receiving the elastic pieces being formed at the outer periphery of the guiding member.

9. The operational switch as claimed in claim 6, wherein the rotation guiding means include a pair of elastic pieces protrudingly formed on the control panel opposite to each other and a ring type guiding member provided on one side of the first gear and a plurality of grooves receiving the elastic pieces being formed at the outer periphery of the guiding member.

10. An operational switch for a microwave oven comprising a knob inserted rotatably into a control panel;

a first gear, at a center of the first gear the knob having a shaft being inserted, on one face of the first gear a pair of pushing pieces being protrudingly formed, at an edge of the pushing pieces a stopper being formed to contact with a pair of impeding pieces projected on the control panel, and a ring type guiding member with a plurality of grooves to receive a pair of elastic pieces protrudingly and oppositely formed on the control panel being provided on the same side thereof;

a first switch for controlling a magnetron by means of the pushing pieces of the first gear;

a second gear meshed with the first gear by teeth, a pair of pushing pieces being protrudingly formed on one face of the second gear, and a small-sized gear meshed with a gear of the magnetron for controlling the magnetron power being provided on an opposite face of the second gear; and a second switch for controlling an electric heater by means of the pushing pieces of the second gear, whereby the rotation of the knob is transmitted to the first gear, the rotational position of the pushing piece of the first gear controls and closes the first switch, the rotation of the first gear is transmitted to the second gear, and the rotational position of the pushing piece of the second gear turning on/off the second switch and simultaneously rotates the power controlling gear.

* * * * *